US005980326A

United States Patent [19]

Weidner et al.

[11] Patent Number: 5,980,326

[45] Date of Patent: Nov. 9, 1999

[54] SEALED BULKHEAD COAXIAL JACK AND RELATED METHOD

[75] Inventors: Kevin E. Weidner, Hummelstown; John Timothy Lippert, Harrisburg, both of Pa.

[73] Assignee: The Whitaker Corporation, Wilmington, Del.

[21] Appl. No.: 09/092,015

[22] Filed: Jun. 4, 1998

[51] Int. Cl.[6] ..... H01R 17/04

[52] U.S. Cl. ..... 439/675; 439/426

[58] Field of Search ..... 439/63, 581, 578, 439/675, 638, 851, 856, 857, 723, 724, 82, 839, 218, 426

[56] References Cited

U.S. PATENT DOCUMENTS

| | | | |
|---|---|---|---|
| 3,681,739 | 8/1972 | Kornick | 339/94 C |
| 4,990,104 | 2/1991 | Schieferly | 439/578 |
| 4,990,105 | 2/1991 | Karlovich | 439/578 |
| 5,135,403 | 8/1992 | Rinaldi | 439/82 |
| 5,468,163 | 11/1995 | Egenolf | 439/839 |
| 5,514,001 | 5/1996 | Szegda | 439/263 |
| 5,556,292 | 9/1996 | Kato | 439/218 |
| 5,607,325 | 3/1997 | Toma | 439/578 |
| 5,660,565 | 8/1997 | Williams | 439/585 |
| 5,704,809 | 1/1998 | Davis | 439/578 |

OTHER PUBLICATIONS

U.S. Patent Application Serial No. 09/053,579 filed Apr. 1, 1998 (Abstract and Drawings only included).

*Primary Examiner*—Neil Abrams
*Assistant Examiner*—Javaid Nasri

[57] ABSTRACT

A sealed bulkhead coaxial jack (100) that includes a shell (200), a front dielectric (300), a rear dielectric (400) having a projection ring (404), a front seal (500), a contact (600), and a pin (700). The shell (200) has a metal cylindrical sidewall (201) with the sidewall (201) having retaining lips (204,205). The front dielectric (300) fits snugly within the front shell portion (202) and is constructed of a cylindrical sidewall (301), a front face (302) having an opening (302*a*) therethrough, and an open rear end. The rear dielectric (400) is a generally solid cylinder block (401) having a passage therethrough. The rear dielectric (400) has a projection ring (404) that encircles and extends away from its outer surface, providing an internal seal for the jack. The front seal (500) is positioned in the front opening (204*a*) of the shell between the front retaining lip (204) and the front face (302) of the front dielectric (300). The contact (600) has a front portion having a dual beam configuration in proximity to the front shell opening (204*a*) and is capable of receiving a center conductor of a coaxial cable. The contact (600) also has a rear portion having a triple beam configuration located within the passage of the rear dielectric (400) with a rear portion electrically connected to a pin (700) that extends from its connection within the rear dielectric passage beyond the rear opening (205*a*) of the shell (200).

39 Claims, 4 Drawing Sheets

Fig. 2
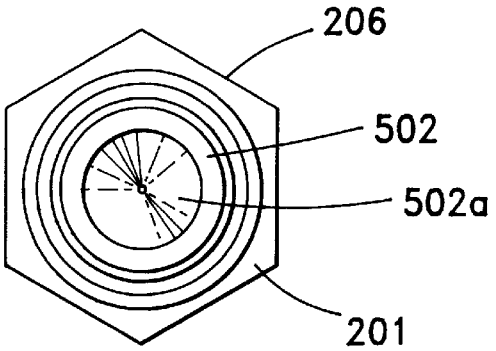
Fig. 3
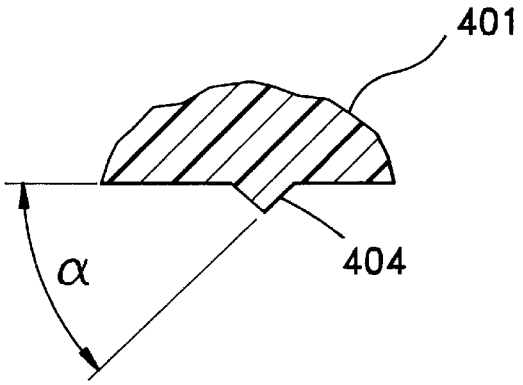
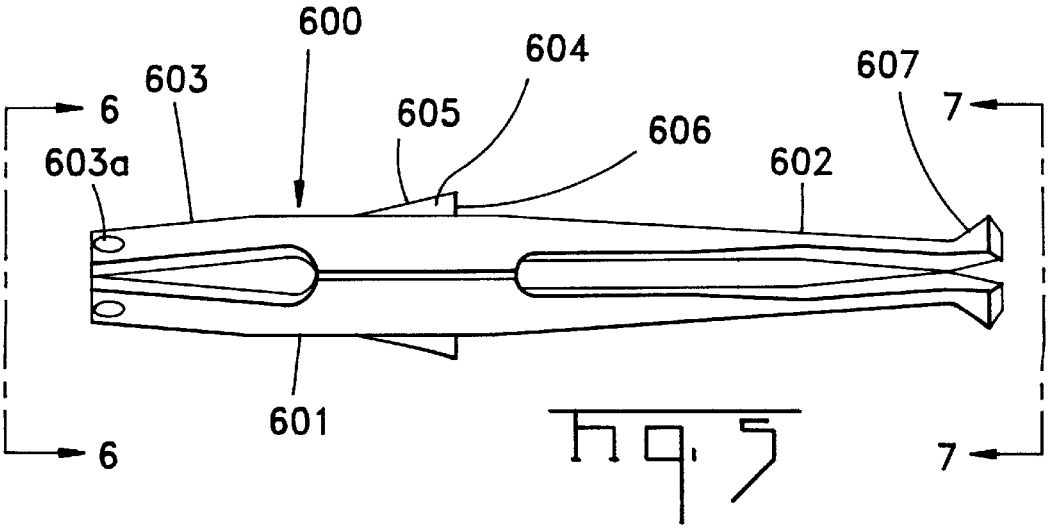
Fig. 5

SEALED BULKHEAD COAXIAL JACK AND RELATED METHOD

BACKGROUND OF THE INVENTION

1. Field of the Invention

The present invention relates to an improved jack for use with a coaxial cable. More particularly, the improved jack of the present invention relates to improved seals for preventing moisture from entering into and flowing through the jack and also relates to a center contact that is a stamped, dual socket female contact that will optimize RF performance while providing the ability to mate with the center conductor of a coaxial cable.

2. Description of Related Art

Various attempts have been made in the industry in an effort to develop better internal and external seals for coaxial jacks with a varied amount of success. Typical jacks may leak moisture into the interior of the jack through the front or rear openings, thereby increasing the chance of an electrical failure. Moisture that does find its way into the inside of the jack often then migrates between the inner surface of the housing and the outer surface of the dielectric material, potentially disrupting the electrical connection.

Another disadvantage of a conventional coaxial jack is that the center receptacle contact is not as efficient as it could be. A typical stamped center contact is usually constructed of two thin ribbons of flat metal that are bent to form a receptacle for a center conductor of a coaxial cable. This construction, while low in cost, typically results in poor RF performance and offers little control of the characteristic impedance. Equivalent contacts that are machined instead of stamped provide better performance but involve a significant increase in production cost.

Another problem with certain types of conventional contacts is the inability to accommodate various sizes of conductors with which the contacts are mated.

Accordingly, there remains a need for a coaxial jack that provides more efficient means of sealing the jack internally as well as externally. Furthermore, there also remains a need for an improved jack that includes a cost-effective contact that facilitates improved RF performance, allows better control of characteristic impedance, and can receive conductors having a range of diameters.

SUMMARY OF THE INVENTION

The present invention relates to a sealed bulkhead coaxial jack that includes a shell, a front dielectric, a rear dielectric having a projection ring, a front seal, a contact, and a pin. The shell is a unitary metal hollow cylinder construction that, for the purpose of this discussion, is divided into a front portion and a rear portion with the shell having openings at both ends. The front dielectric is also a hollow cylinder construction made of a non-conducting material that fits snugly within the front portion of the shell. The rear dielectric, also made of a non-conducting material, is a generally solid cylindrical construction having a passage therethrough along a longitudinal axis of the cylinder. The rear dielectric also has a projection ring that encircles the outer surface of it. The front seal is fixed in the front opening of the shell between a lip of the front portion of the shell and the front face of the front dielectric. The contact is positioned within the shell with a front potion having two beams extending therefrom and in proximity to the front opening of the shell and is capable of receiving a center conductor of a coaxial cable. The contact also has a rear portion that has a triple-beam construction that is located within the passage of the rear dielectric. The rear portion of the contact is electrically connected to a pin that extends from its connection within the rear dielectric passage beyond the rear opening of the shell to a printed circuit board or other electrical component.

The present invention provides important advantages over the prior art. One important advantage is the improved internal sealing capabilities.

Another advantage of the design of the present invention is that the contact facilitates improved RF performance (dB return Loss) with a coaxial curved beam/tubular design.

Another advantage is that the design of the contact allows better control of characteristic impedance.

Yet another advantage is that the present invention provides a low cost stamped contact design.

Additional advantages of the present invention will become apparent to those skilled in the art from the following detailed description of the preferred embodiment, which exemplifies the best mode of carrying out the invention.

The invention itself, together with further objects and advantages, can be better understood by reference to the following detailed description and the accompanying drawings.

BRIEF DESCRIPTION OF THE DRAWINGS

FIG. 2 is an end view of the jack of FIG. I taken about the line 2—2.

FIG. 3 is an enlarged partial view of the rear dielectric of the jack of FIG. 1.

FIG. 5 is an enlarged side elevation view of the contact of the jack of FIG. 1.

DETAILED DESCRIPTION OF THE PRESENT INVENTION

Figure 1:
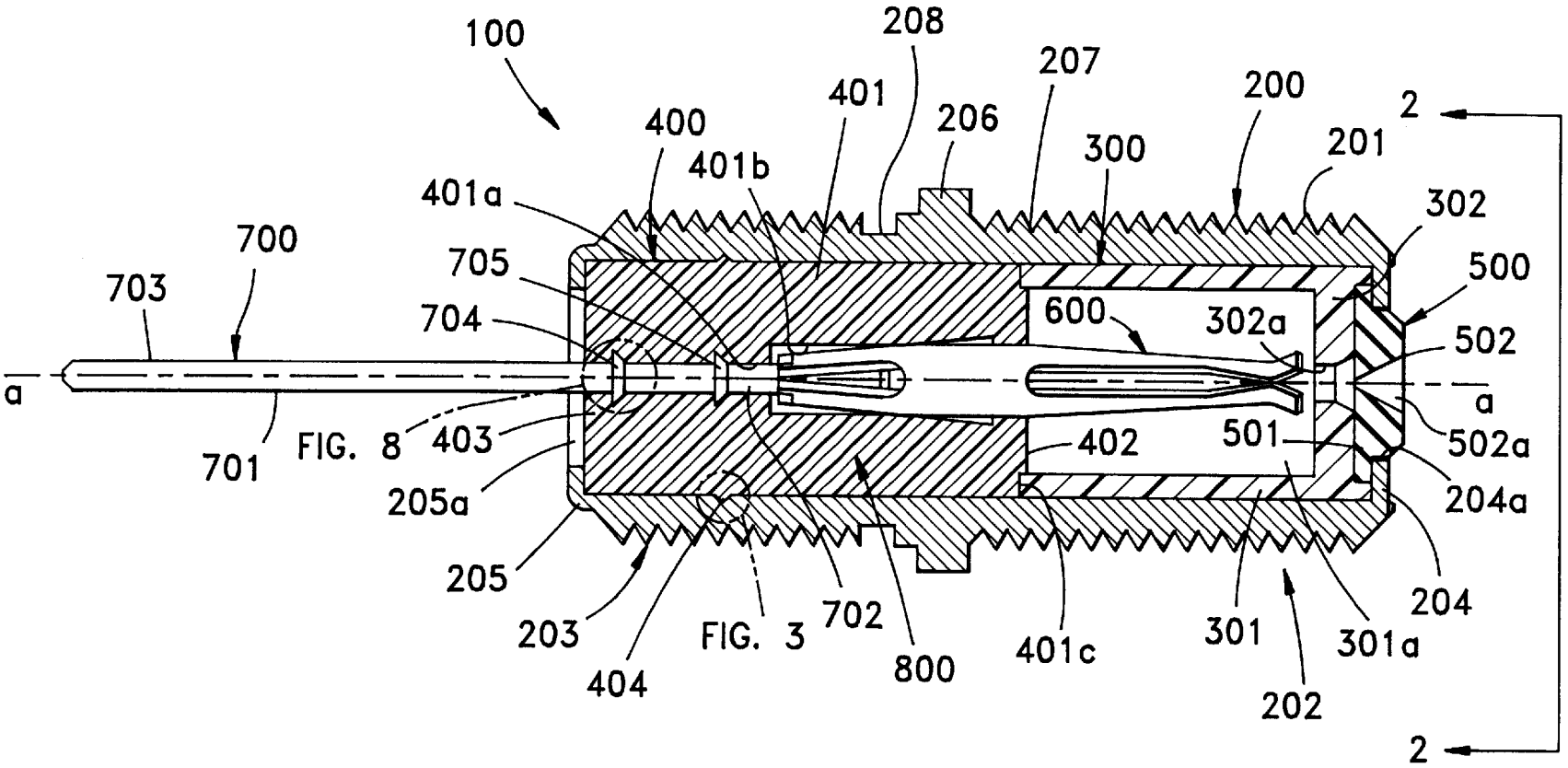
FIG. 1 is a side elevational view the preferred embodiment of the assembled jack of the present invention.

Referring now to FIGS. 1–8, in the preferred embodiment, the jack 100 includes a shell 200, a front dielectric 300, a rear dielectric 400, a front seal 500, a contact 600, and a pin 700, of which the rear dielectric 400, the contact 600, and the pin 700 together make up a subassembly 800.

Figure 4:
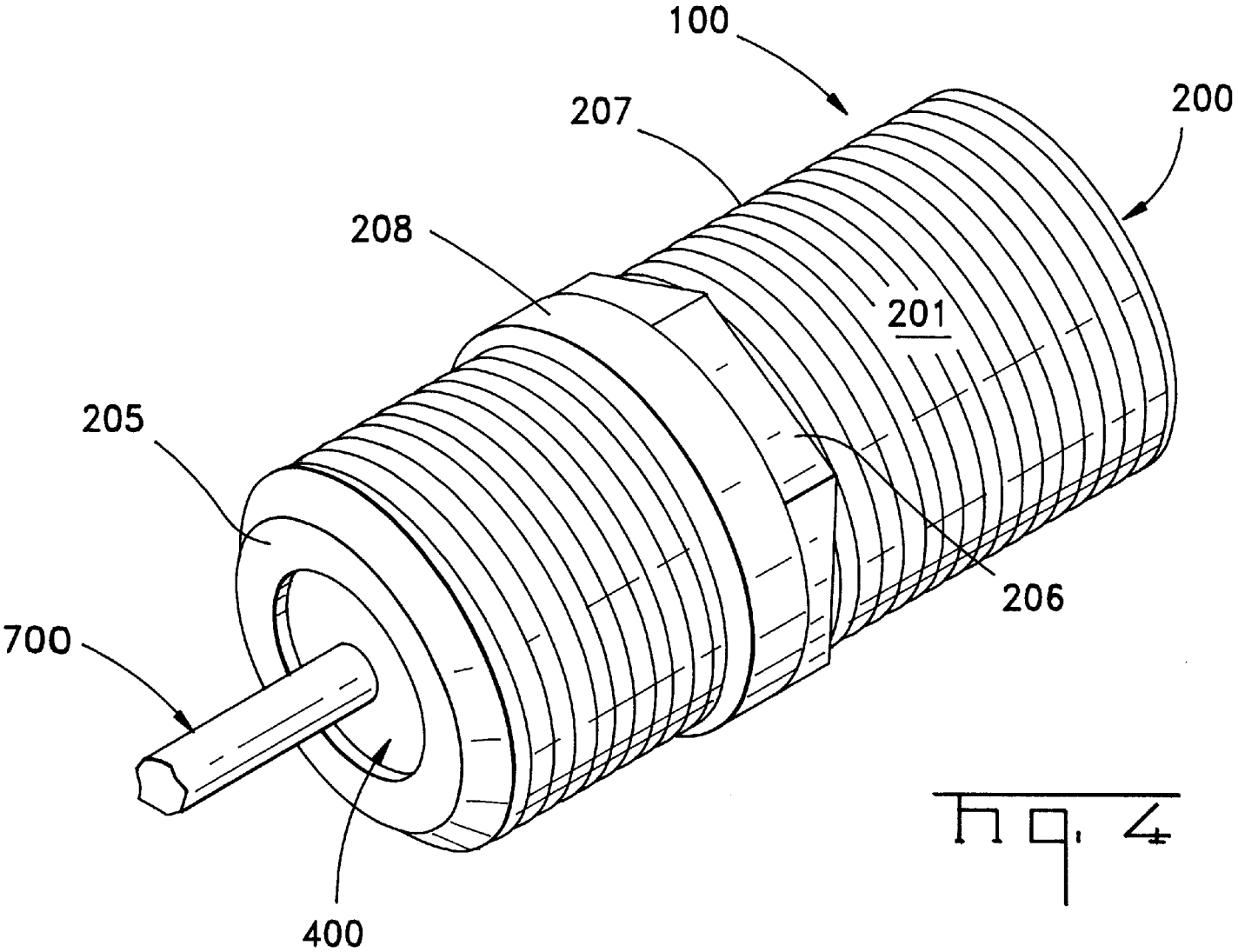
FIG. 4 is a perspective view of the jack of FIG. 1.
Figure 7:
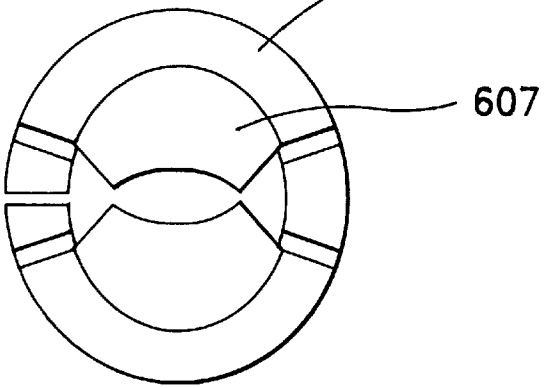
FIG. 7 is an end view of the contact& of FIG. 5 taken along the line 7—7.
Figure 6:
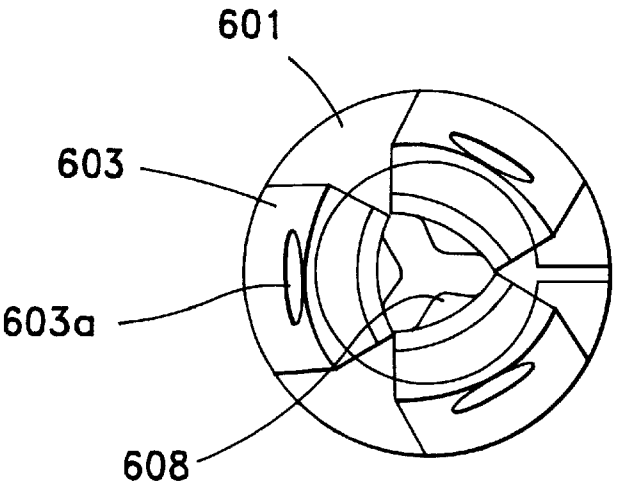
FIG. 6 is an end view of the contact of FIG. 5 taken along the line 6—6.

The shell 200 includes a cylindrical sidewall 201 having a front portion 202, a rear portion 203, and an imaginary longitudinal axis a extending the length of the shell 200 and beyond, best shown in FIG. 1. The front portion 202 includes a retaining lip 204 that begins at the sidewall 201 and extends radially inward, defining a front shell opening 204*a*. The rear portion 203 includes a retaining lip 205 (the details of which will be discussed later herein) that begins at the sidewall 201 and extends radially inward, defining a rear shell opening 205*a*. The shell 200 also includes a hexagonal flange 206 that encircles the sidewall 201 about halfway between the front portion 202 and the rear portion 203 of the shell 200 as shown. In the preferred embodiment, the sidewall 201, retaining lips 204 and 205, and the hexagonal flange 206 are all constructed of a base metal, usually brass or zinc, plated with copper and/or nickel, or the like. Finally, the outer surface of the shell 200 has threads 207 and a knurled geometry 208 as shown in FIGS. 1 and 4.

The front dielectric 300 is made up of a cylindrical sidewall 301 and a front face 302 that defines an open rear end 301*a* forming a dielectric cavity. The front face 302 has an opening 302*a* as shown in FIG. 1. The front dielectric is made of a non-conducting material such as polymethylpentene or other suitable material.

The rear dielectric 400 includes a cylindrical block 401 of non-conducting material similar or identical the material of the front dielectric 300. The block 401 has a front face 402, a rear face 403. The front face 402 of the block 401 has a "stepped-down" diameter; that is, the outer diameter of the front face 402 is slightly less than the outer diameter of the cylindrical block 401, as shown in FIG. 1. The cylindrical block 401 also has a passage therethrough having a first portion 401*a* and a second portion 401*b*, the diameters of which are different, also shown in FIG. 1. Another important feature of the rear dielectric is a projection ring 404 that can be described as a V-shaped ridge projecting outwardly from and encircling the outer surface of the cylindrical block 401, best shown in FIG. 3. Each sloped side of the projection ring 404 forms an angle $\alpha$ with respect to the surface of the cylindrical block 401, which is 45° in the preferred embodiment, also shown in FIG. 3.

The front seal 500 includes a generally round mass of flexible material such as silicone rubber or the like having a relatively thin seal ring 501 and a seal body 502. The seal body 502 projects away from the seal ring 501 and has a diameter less than that of the seal ring 501. The seal body 502 has a conical seal basin 502*a* therein that is geographically centered in the seal body 502. The seal basin 502*a* narrows to the point that, without an external inducement, the seal body 502 acts as a barrier to prevent moisture from entering the shell 200. However, the seal body 502 is pierced through at the point where the seal basin 502*a* converges and thus will allow a slender object such as a center conductor (not shown) of a coaxial cable (also not shown) to penetrate.

The contact 600 includes a contact body 601, front beams 602, rear beams 603, and retention barbs 604, best shown in FIG. 5. The contact 600, which is typically stamped and formed into a tubular/coaxial configuration, is shown as a "set" view, i.e., the view of the contact 600 as it would appear prior to having the front beams 602 mated with a center conductor from a coaxial cable (not shown) and prior to the rear beams 603 mated with a pin shaft 701. The contact body 601 is generally aligned with the longitudinal axis $\alpha$ and provides a base for the front beams 602, also shown in FIG. 7, and the rear beams 603, also shown in FIG. 6, that project away from the contact body 601. The front beams 602 include front beam tips 607 that extend away from and at an angle to the front beams 602 as shown in FIG. 5. The function of the angled front beam tips 607 is described later herein. The rear beams 603 include indentations 603*a* that are stamped into the rear beams 603 to create contact points 608, the function of which is also described later herein. The contact 600 also includes the retention barbs 604, the operation of which will be explained later herein. The retention barbs 604 are relatively thin "fins" which extend out away from the contact body 601 and have a tapered or angled leading edge 605 and a perpendicular trailing edge 606 as shown in FIG. 5.

Figure 8:
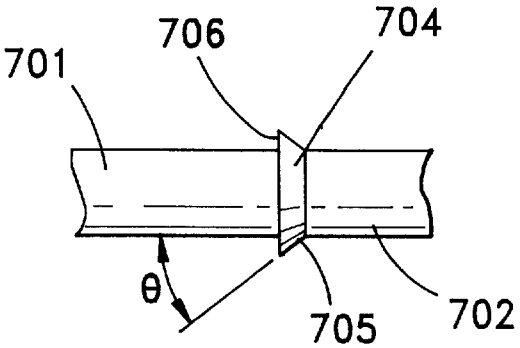
FIG. 8 is an enlarged partial view of the pin of the jack of FIG. 1.

The pin 700 includes a pin shaft 701 having a front end 702 and a rear end 703, the pin shaft 701 being substantially aligned with the longitudinal axis $\alpha$, further described later herein. The pin shaft 701 features retention barbs 704 as shown in FIG. 8, which may be of differing sizes, if so desired. The barbs 704 begin at the outer surface of the pin shaft 701 and extend radially outward. In the preferred embodiment, each barb 704 has a tapered leading edge 705 that form an angle $\theta$ with respect to the pin shaft 701 and a trailing edge 706 that is substantially perpendicular to the pin shaft 701, best shown in FIG. 8. The angle $\theta$ of the leading edge 705 of each retention barb 704 may be identical or different, depending on the selection of the designer.

Assembly of the jack 100 is as follows. First, the rear dielectric 400, the contact 600 and the pin 700 are constructed into a subassembly 800. The front end 702 of the pin shaft 701 is inserted into first passage portion 401*a* of the rear dielectric cylinder block 401 and the rear beams 603 of the contact 600 are inserted into the second passage 401*b* of the rear dielectric cylinder block 401. As the pin shaft 701 is advanced through the passage 401*a* toward the front of the rear dielectric cylinder block 401, the retention barbs 705 of the pin shaft 701 engage the dielectric material of the rear dielectric cylinder block 401 and the angled leading edges 705 help reduce the resistance to the pin shaft 701 movement. Similarly, as the rear beams 603 are advanced through second passage 401*b* toward the rear of the rear dielectric cylinder block 401, the retention barbs 604 engage the dielectric material of the rear dielectric cylinder block 401 and the angled leading edges 605 help reduce the resistance to the movement of the pin shaft 701. Both the pin shaft 701 and the contact 600 are advanced toward each other until the front end 702 of the pin shaft 701 engages the rear beams 603 at the contact points 608. Once the pin shaft 701 and the rear beams 603 are fully engaged, the trailing edges 606 and 706 of the retention barbs 604 and 704, respectively, assist in preventing the pin 700 and the contact 600 from disengaging by providing resistance against the material of the rear dielectric cylinder block 401.

After constructing the aforementioned subassembly 800, the front seal 500 is inserted through the rear opening 205*a* of the shell and advanced to the front opening 204*a* of the front end 204 of the shell 200 as shown in FIG. 1. The front dielectric 300 is likewise inserted into the front end 204 of the shell 200, trapping the front seal ring 501 between the front retaining lip 204 and the front face 302 of the front dielectric 300.

Next, the subassembly 800 is "press fit" into the rear portion 203 of the shell 200. That is, the rear dielectric cylinder block 401 of the subassembly 800 is compressed and forced into the rear portion 203 of the shell 200 as shown in FIG. 1. As the subassembly 800 is released, the outer surface of the rear dielectric cylinder block 401 bears tightly against the inner surface of the sidewall 201 of the shell 200, thereby forming a seal. The projection ring 404 also bears against the inner surface of the sidewall 201 and provides additional radially compressive force directed towards the retention barb 704 with which the projection ring 404 is substantially aligned, as shown in FIG. 1. This compressive force also forms a seal around the retention barbs 704 of the pin shaft 701. Moreover, the sidewall 301 of the front dielectric 300 engages the groove 401*c* formed by the front face 402 of the rear dielectric cylinder block 401 and the inner surface of the sidewall 201 of the shell 200, also shown in FIG. 1, thereby forming a seal. As a final step, a small area of the rear portion 203 of the sidewall 201 is formed inward thereby creating the retaining lip 205 that prevents the subassembly 800 and other components from exiting through the rear opening 205*a*.

The operation of the jack and contact is relatively simple. Near the rear portion 203 of the shell 200, the rear portion 703 of the pin shaft 701 is connected to a printed circuit board (not shown) or other electrical component (also not shown). At the front portion 202 of the shell 200, a coaxial cable (not shown) of conventional construction is mated with the jack 100. As the coaxial cable is advanced toward the jack 100, a center conductor (not shown) of the cable passes through the front seal opening 501*a*, through the opening 302*a* of the front dielectric front face 302, and frictionally engages the front beams 602 of the contact 600. In the case of a slightly bent center conductor, the cone shape of the front seal opening 501*a*, the taper of the opening 302*a* of the front dielectric front face 302, and the flared configuration of the front beams 602 all assist in aligning the center conductor with the front beams 602. As the center conductor (not shown) starts to engage the front beams 602, the front beams 602 spread apart to receive the center conductor and form a proper electrical connection. The flexibility of the front beams 602 allows center conductors of varying diameters to be received by the front beams 602.

Simultaneous with the engaging of the center conductor with the front beams 602, the threaded inner surface of the coupling hardware (not shown) of the coaxial cable engages the threads 207 on the outer surface of the sidewall 201 of the shell 200. The knurled outer surface 208 of the sidewall 201 enhances the ground circuit contact with the coupling hardware by scraping its surface as the coaxial cable is advanced to its fully connected position.

Of course, it should be understood that a wide range of changes and modifications could be made to the exemplary embodiments described above. It is therefore intended that the foregoing detailed description be regarded as illustrative rather than limiting and that it be understood that it is the following claims, including all equivalents, which are intended to define the scope of this invention.

What is claimed is:

1. An electrical jack, comprising:

a shell comprising a cylindrical sidewall, a front opening and a rear opening, said shell having a front portion and a rear portion; thereby a front dielectric being disposed within said front portion of said shell;

a rear dielectric having a passage therethrough, said rear dielectric being disposed within said rear portion of said shell;

a seal being disposed within said front opening of said shell for preventing moisture from entering said front opening;

a contact having a front end and a rear end, said contact being disposed within said shell such that said front end of said contact is within close physical proximity to said seal, said rear end of said contact being disposed within said passage of said rear dielectric, said contact capable of being electrically connected to a center conductor of a coaxial cable;

a pin being at least partially inserted into said rear portion of said shell and being electrically connected to said rear end of said contact; and, a projection ring being located on the outer surface of said rear dielectric, said projection ring being in contact with the inner surface of said shell whereby radially compressing said rear dielectric.

2. The electrical jack according to claim 1 wherein said front dielectric comprises a cylindrical side wall, a front face having an opening therethrough, and an open rear end, the outer surface of said cylindrical side wall frictionally engaging the inner surface of said front portion of said shell.

3. The electrical jack according to claim 2 wherein said rear dielectric comprises a cylinder of material, the outer surface of said cylinder frictionally engaging the inner surface of said rear portion of said shell, said passage being oriented along a longitudinal axis of said cylinder.

4. The electrical jack according to claim 3 wherein said rear dielectric is comprised of an electrically non-conductive material.

5. The electrical jack according to claim 4 wherein said rear dielectric further comprises a front face having a diameter slightly less than that of said cylinder thereby forming a groove between the inner surface of said sidewall of said shell and the peripheral edge of said front face of said rear dielectric.

6. The electrical jack according to claim 5 wherein said cylindrical sidewall of said front dielectric engages said groove.

7. The electrical jack according to claim 1 wherein said front dielectric is comprised of an electrically non-conductive material.

8. The electrical jack according to claim 1 wherein said shell further comprises a first retaining lip extending radially inward from said cylindrical sidewall of said front portion of said shell and a second retaining lip extending radially inward from said cylindrical sidewall of said rear portion of said shell.

9. The electrical jack according to claim 8 wherein said seal is compressed between the outer surface of said front face of said front dielectric and the inner surface of said first retaining lip of said shell.

10. The electrical jack according to claim 1 wherein said seal comprises a seal body having a seal edge attached thereto, said seal body further having a seal basin therein, said seal basin being generally aligned with said opening of said front dielectric.

11. The electrical jack according to claim 1 wherein said seal is comprised of a flexible material.

12. The electrical jack according to claim 1 wherein said contact comprises:

a contact body comprising a hollow tube having a front portion and a rear portion, said front portion comprising at least two front beams extending from said contact body in one direction and converging at a point along a longitudinal axis of said contact body, said rear portion comprising at least three rear beams extending from said contact body in a direction opposite to said one direction and converging at a point along said longitudinal axis of said contact body.

13. The electrical jack according to claim 12 wherein said at least two front beams of said contact are capable of flexing apart and receiving a center conductor of a coaxial cable therebetween to make an electrical connection, said center conductor having a range of diameters.

14. The electrical jack according to claim 12 wherein said at least three rear beams of said contact are capable of flexing apart and receiving the pin to make an electrical connection, said pin having a range of diameters.

15. The electrical jack according to claim 12 wherein said front portion of said contact body further comprises at least two front beam tips, each of said at least two beam tips projecting away from each of said at least two front beams at an angle thereby forming a generally V-shaped configuration at said front portion of said contact body.

16. The electrical jack according to claim 12 wherein said contact body further comprising a plurality of retention barbs affixed to and extending away from said contact body, each of said retention barbs having an angled leading edge.

17. The electrical jack according to claim 1 wherein said pin comprises a generally elongate rod comprised of a material capable of conducting electricity.

18. The electrical jack according to claim 17 wherein said pin is at least partially disposed within said passage of said rear dielectric.

19. The electrical jack according to claim 18 wherein said pin further comprises means for preventing said pin from exiting said passage of said rear dielectric.

20. The electrical jack according to claim 19 wherein said means for preventing said pin from exiting said passage of said rear dielectric comprises a plurality of retention barbs, each of said retention barbs having an angled leading edge and a substantially perpendicular trailing edge with respect to said longitudinal axis.

21. The electrical jack according to claim 1 wherein said projection ring comprises a triangular ridge that surrounds said rear dielectric and extends away from the outer surface of said rear dielectric, said projection ring having a base and two sides wherein said base of said triangular ridge is an integral part of the outer surface of said rear dielectric.

22. The electrical jack according to claim 21 wherein one side of said triangular ridge forms an angle of approximately 45° with the outer surface of said rear dielectric.

23. A jack for a coaxial cable, comprising:

a shell comprising a cylindrical sidewall, a first end having a retaining lip extending radially inward from said sidewall whereby defining an opening in said first end of said shell, and a second end having a retaining lip extending radially inward from said sidewall defining an opening in said second end of said shell;

a dielectric comprising a mass of electrically non-conductive material being disposed within said shell, the outer surface of said dielectric being frictionally engaged with the inner surface of said shell, said dielectric having a passage extending therethrough, said passage having a first end and a second end, said first end of said passage being generally aligned with the opening in said first end of said shell and said second end of said passage being generally aligned with said opening in said second end of said shell; said dielectric further comprising a projection ring being connected to and projecting away from the outer surface of said dielectric;

a contact disposed within said passage of said dielectric, said contact being generally aligned with said opening in said first end of said dielectric and said opening in said first end of said shell for receiving a center conductor from a coaxial cable passing through said opening in said first end of said shell and through said opening in said first end of said dielectric;

a pin having two ends, one end of said pin being disposed within said passage of said dielectric and being electrically connected to said contact and the other end of said pin extending beyond said opening in said second end of said dielectric and said opening in said second end of said shell;

first seal means for preventing moisture from entering said opening in said first end of said shell;

second seal means for preventing moisture from exiting said opening in said second end of said shell; and, third seal means for preventing moisture from being transferred through the interior of said shell.

24. The jack according to claim 23 wherein said first seal means comprises a mass of flexible material disposed within said opening in said first end of said shell, said first seal means having an opening capable of allowing a center conductor to pass therethrough whereby forming a liquid-tight seal between the center conductor and said mass of flexible material.

25. The jack according to claim 23 wherein said second seal means comprises said dielectric disposed within said opening in said second end of said shell and said pin disposed within said passage through said dielectric, the combination thereof forming a liquid-tight seal thereby preventing moisture from exiting said opening in said second end of said shell.

26. The jack according to claim 23 wherein said third seal means comprises the combination of said cylindrical sidewall of a front portion of said dielectric engaging a groove formed in a perimeter of a front face of a rear portion of said dielectric thereby preventing moisture from being transferred within said shell.

27. The jack according to claim 23 wherein said dielectric comprises a front portion and a rear portion, said front portion comprising a cylindrical sidewall and a front face, said rear portion comprising a solid cylinder of material having a passage therethrough, a front face, and a rear face, said front face of rear portion having a diameter slightly less than that of said solid cylinder thereby forming a groove between the inner surface of said sidewall of said shell and the peripheral edge of said front face of said rear portion of said dielectric.

28. The jack according to claim 27 further comprising a fourth seal means for preventing moisture from being transferred from said front portion and said rear portion of said dielectric.

29. The jack according to claim 28 wherein said fourth seal means comprises a projection ring that surrounds and extends away from the outer surface of said rear portion of said dielectric, said projection ring pressing against the inner surface of said sidewall of said shell, said projection ring providing a compressive force directed radially inward, thereby preventing moisture from being transferred through or around said rear portion.

30. The jack according to claim 29 wherein said projection ring comprises a substantially triangular ridge having a base and two sides wherein said base of said triangular ridge is an integral part of the outer surface of said rear dielectric portion.

31. The electrical jack according to claim 30 wherein one side of said triangular ridge forms an angle of approximately 45° with the outer surface of said rear dielectric portion.

32. A method of assembling a coaxial jack, comprising the steps of:

providing a shell comprising a cylindrical sidewall, a front opening, and a rear opening;

inserting a contact into one end of a passage through a rear dielectric;

inserting a pin into the other end of said passage through said rear dielectric, thereby forming a subassembly of said contact, said rear dielectric, and said pin;

inserting a front seal into said front opening of said shell;

inserting a front dielectric into said shell;

inserting said subassembly into said shell; and, preventing said subassembly, said front dielectric, and said front seal from exiting said shell.

33. The method according to claim 32 further comprising the step of preventing said contact from exiting said passage of said rear dielectric.

34. The method according to claim 33 wherein said step of preventing said contact from exiting said passage of said rear dielectric comprises the step of utilizing contact retention barbs.

35. The method according to claim 32 further comprising the step of preventing said pin from exiting said passage of said rear dielectric.

36. The method according to claim 35 wherein said step of preventing said pin from exiting said passage of said rear dielectric comprises the step of utilizing pin retention barbs.

37. The method according to claim 32 wherein said contact comprises a front portion and a rear portion, said front portion having a dual beam configuration and said rear portion having a triple beam configuration.

38. The method according to claim 37 wherein said step of inserting said pin into said passage through said rear dielectric comprises the step of inserting said pin into said triple beam configuration, said pin forcing the beams of said triple beam configuration to spread apart and receive said pin thereby forming an electrical connection between said pin and said contact.

39. The method according to claim 32 where said step of preventing said subassembly, said front dielectric, and said front seal from exiting said shell comprises the step of forming a retention lip in said sidewall.

* * * * *